US005109631A

United States Patent [19]

Biebesheimer et al.

[11] Patent Number: 5,109,631

[45] Date of Patent: May 5, 1992

[54] FINISH-MACHINING MACHINE COMPRISING MEANS FOR FEEDING AN ABRASIVE SLURRY AT A CONTROLLED RATE

[75] Inventors: Klaus Biebesheimer, Frankfurt am Main; Alexander Hofsess, Dreieich; Dieter Simpfendörfer, Mühlheim/M., all of Fed. Rep. of Germany

[73] Assignee: Diskus Werke Frankfurt am Main Aktiengesellschaft, Frankfurt, Fed. Rep. of Germany

[21] Appl. No.: 554,144

[22] Filed: Jul. 16, 1990

[30] Foreign Application Priority Data

Jul. 31, 1989 [DE] Fed. Rep. of Germany ..... 3925274
May 21, 1990 [DE] Fed. Rep. of Germany ..... 4016335

[51] Int. Cl.[5] ..... B24B 37/04; B24B 57/02

[52] U.S. Cl. ..... 51/111 R; 51/118; 51/263; 51/292

[58] Field of Search ..... 51/117, 118, 111 R, 51/263, 292, 131.3, 131.2, 132

[56] References Cited

U.S. PATENT DOCUMENTS 267,783 11/1882 Folsom ..... 51/111 R
1,476,863 12/1923 Weaver ..... 51/118
2,973,605 3/1961 Carman et al. ..... 51/118
3,978,621 9/1976 Janssen ..... 51/111 R

*Primary Examiner*—Robert A. Rose
*Attorney, Agent, or Firm*—Dvorak and Traub

[57] ABSTRACT

This invention relates to a finish-machining machine comprising two finishing disks, which are centered on a vertical axis, and means for feeding an abrasive slurry at a controlled rate to the working gap between said disks. The invention is particularly applicable to such a machine which can be used for lapping, finish-grinding and/or polishing. The machine is provided with such feeding means for feeding the abrasive slurry at a controlled rate, which is consistent with the specification of the workpieces which are to be finished and the selected machining conditions. The upper finishing disk is formed on its top surface with one annular groove or with a plurality of annular grooves, which communicate through bores with the working gap between the finishing disks and the means for feeding the abrasive slurry comprise scraping means, which are operable to rotate relative to the upper finishing disk and to deliver said abrasive slurry to said groove or grooves and comprise a plurality of scrapers, which constitute an array that is centered on the axis of the upper finishing disk, and separate drive means are provided for rotating said scraping means independently of the upper finishing disk preferably in a sense that is opposite to the sense of rotation of the upper finishing disk when the upper finishing disk rotates at a speed below a predetermined limit.

13 Claims, 2 Drawing Sheets

FINISH-MACHINING MACHINE COMPRISING MEANS FOR FEEDING AN ABRASIVE SLURRY AT A CONTROLLED RATE

BACKGROUND OF THE INVENTION

Field of the Intention

This invention relates to a finish-machining machine comprising two finishing disks, which are centered on a vertical axis, and means for feeding an abrasive slurry at a controlled rate to the working gap between said disks. The invention is particularly applicable to such a machine which can be used for lapping, finish-grinding and/or polishing.

SUMMARY OF THE INVENTION

Owing to the versatility of such finish-machining it is desired to feed the abrasive slurry to the working gap between the finishing disks at a selected uniform rate, which is satisfactory for the finishing operation which is to be performed. It is an object of the invention to provide such a machine with feeding means for feeding the abrasive slurry at a controlled rate, which is consistent with the specification of the workpieces which are to be finished and the selected machining conditions.

In a finish-machining machine which is of the kind defined first hereinbefore that object is accomplished in accordance with the invention in that the upper finishing disk is formed on its top surface with one annular groove or with a plurality of annular grooves, which communicate through bores with the working gap between the finishing disks and the means for feeding the abrasive slurry comprise scraping means, which are operable to rotate relative to the upper finishing disk and to deliver said abrasive slurry to said groove or grooves and comprise a plurality of scrapers, which constitute an array that is centered on the axis of the upper finishing disk, and separate drive means are provided for rotating said scraping means independently of the upper finishing disk preferably in a sense that is opposite to the sense of rotation of the upper finishing disk when the upper finishing disk rotates at a speed below a predetermined limit.

In accordance with a further feature of the invention the abrasive slurry is supplied to the scrapers through a vertical flow pipe which has an open bottom end for discharging the abrasive slurry, a dripping pipe, which is parallel to and laterally offset from the flow tube and is provided at its top end with a collecting funnel, which is upwardly inclined toward the bottom and of said flow pipe, and a jet nozzle, which is disposed on that side of the axis of the flow pipe which is opposite to said dripping pipe and directed toward said funnel and is adapted to discharge a pulsed air jet having a variable strength and/or a variable pulse frequency.

DETAILED DESCRIPTION OF THE PREFERRED EMBODIMENT

Figure 1:
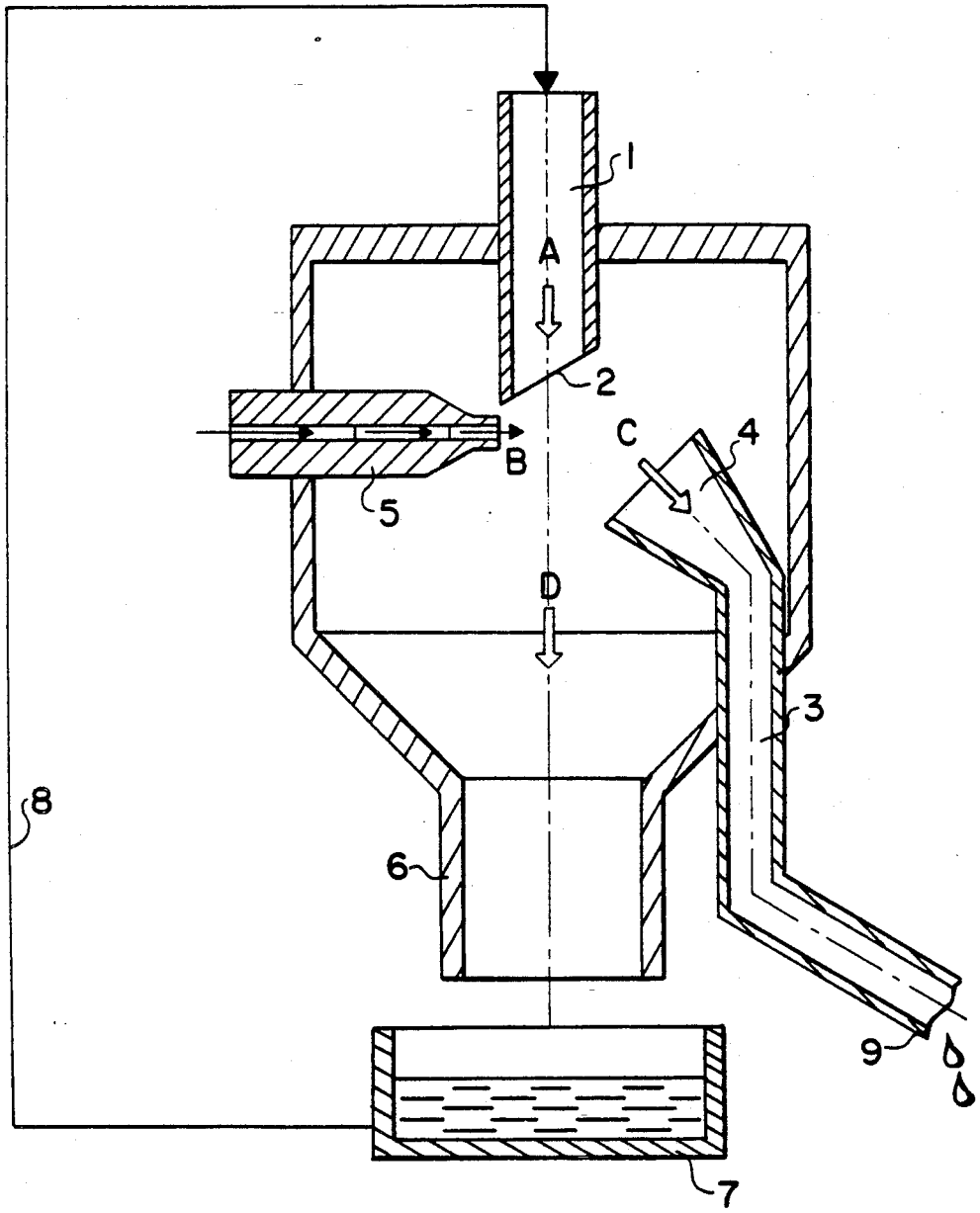
FIG. 1 is a diagrammatic view illustrating the means for feeding an abrasive slurry at a controlled rate.

A preferred embodiment of the means provided in accordance with the invention for feeding an abrasive slurry at a controlled rate will now be described with reference to the drawing.

It is apparent from FIG. 1 that an abrasive slurry (lapping slurry) is supplied through a vertical flow pipe 1, which has a beveled end face defining an open bottom end 2. A dripping pipe 3 is also provided, which is parallel to and laterally offset from the axis of the flow pipe 1 and disposed below the bottom end 2 of the flow pipe 1. The dripping pipe 3 is provided at its top end with a collecting funnel 4, which is disposed below and upwardly inclined toward the bottom end 2 of the flow pipe 1 but spaced from the axis thereof. A horizontal jet nozzle 5 is provided, which is aligned with the axis of the flow pipe 1 and disposed on that side of said axis which is opposite to the funnel 4 and is operable to discharge an air jet B, by which a part of the abrasive slurry discharged from the bottom end 2 of the flow pipe 1 is deflected to enter the funnel 4 in the direction C. The rate of that deflected part depends on the variable strength and/or the variable pulse rate of the air jet. The undeflected part of the abrasive slurry drops in the direction D through the discharge pipe 6 into the reservoir 8 and can be pumped from the latter through line 8 to the flow pipe 1.

One or more of the dripping pipes 3 and one or more associated jet nozzles 5 may be provided. Said dripping pipe or each of said dripping pipes has an open bottom end 9, from which the deflected part of the abrasive slurry drops one or more annular grooves 10, which are formed on the top surface of the upper finishing disk 11 and which communicate through angularly spaced apart bores 12 in the upper disk 11 with the working gap 13 defined by the upper and lower finishing disks 11 and 14, as is apparent from FIG. 2.

Figure 2:
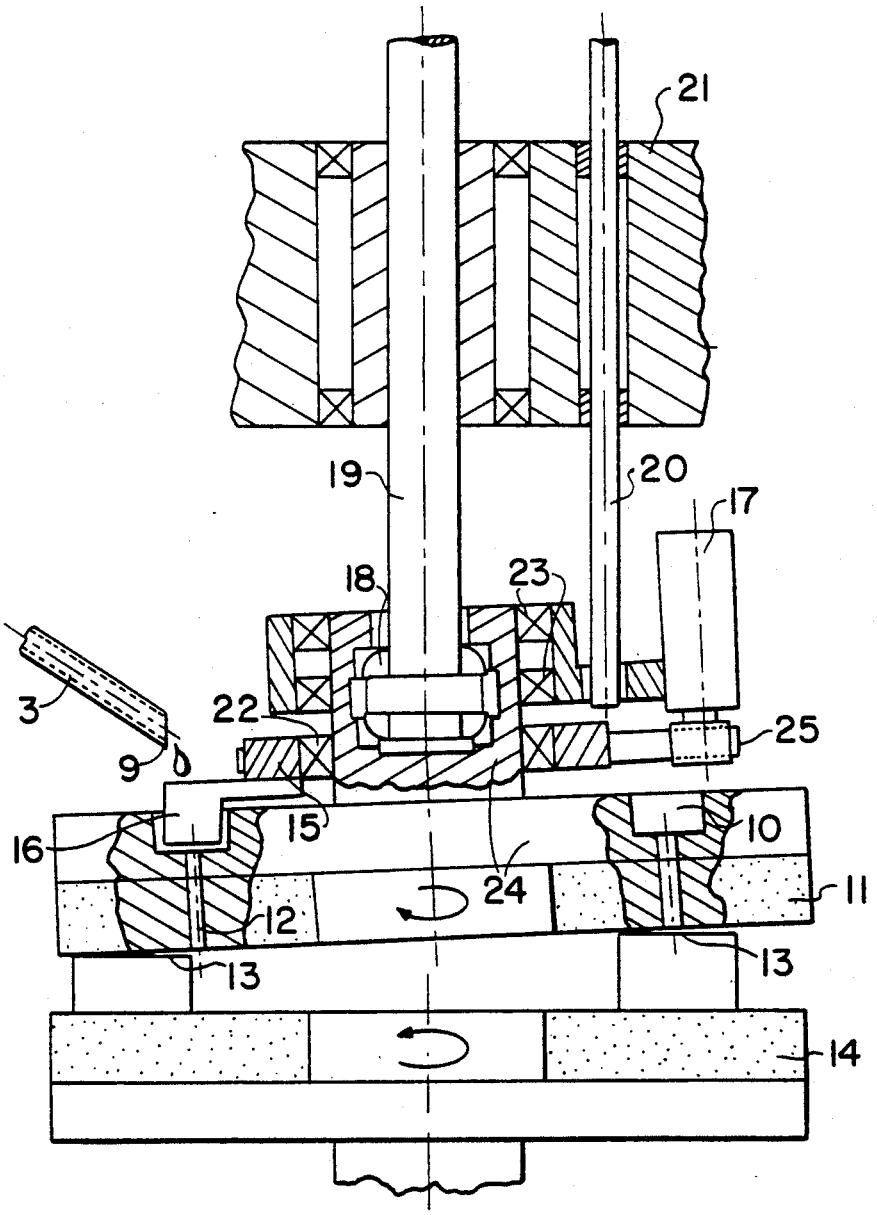
FIG. 2 is a diagrammatic representation of the means for distributing the abrasive slurry.

A uniform distribution of the abrasive slurry which has been discharged from the dripping pipe or pipes 3 is effected in accordance with FIG. 2 by scraping means 15, which are rotated relative to the upper finishing disk 11 by separate drive means 17 and comprise a plurality of scrapers 16, which extend at right angles to the axis X of the upper finishing disk 11. By the drive means 17 the scraping means 15 are rotated in a sense which is opposite to the sense of rotation of the upper finishing disk 11 when the latter is rotated at a speed which is below a predetermined limit.

A shaft 19 is axially adjustably mounted in a top frame 21 of the machine for rotation on the vertical axis X. The upper finishing disk 11 is secured to a carrier 24, which is mounted on the shaft 19 for a self-aligning movement by means of a self-aligning bearing 18. The drive means 17 for the scraping means 15 are held against a rotation with the shaft 19 relative to the top frame 21 by a guide rod 20, which is radially spaced from and parallel to the axis X and is slidably mounted in the top frame 21 and in a bracket by which said drive means 17 are supported on a mounting ring, which is rotatably mounted on a carrier 24 for the upper finishing disk 11 by bearing means 23, which cause the drive means 17 to follow the self-aligning movement of the upper disk 11. The scraping means 15 are rotatably mounted on the carrier 24 by the bearing 22 and can be rotated, e.g., by a drive belt 25, which is driven by the drive means 17.

It is apparent that the upper and lower finishing disks 11 and 14 are mounted to be rotatable on a vertical axis of rotation X. The upper disk 11 has a top surface and a bottom surface, which faces and defines a working gap 13 with the lower disk 14. The upper disk 11 is formed in its top surface with annular groove means 10, which are centered on the axis X, and is formed with a plurality of bores 12, which are spaced around the axis 11 and open in the groove means 10 and in the bottom surface of the upper disk 11. Scraping means 15 are provided, which extend into the groove means 10 and are mounted to be rotatable on the axis X relative to the upper disk 11. The scraping means 15 comprise a plurality of scrapers 16, which extend into the groove means 10 and constitute an array which is centered on the axis X.

By the self-aligning bearing 18 the upper disk 11 is mounted in the top frame 21 for rotation on the axis X by the shaft 19 and for a self-aligning movement relative to the top frame 21. By means of the shaft 19, the self-aligning bearing 18, the carrier 24 and the guide rod 20 the bearings 23 the drive means 17 for the scraping means 15 are movably mounted in the top frame 21 so as to retain the drive means 17 against an angular movement relative to the top frame 21 about the axis X and to permit the drive means 17 to perform a self-aligning movement in unison with the upper disk 11. The carrier 24 is mounted in the top frame 21 to be rotatable on the axis X and is non-rotatably connected to the upper disk 11. The scraping means 15 and the drive means are rotatably mounted on the carrier 24 by bearings 22 and 23, respectively.

Means are provided for supplying an abrasive slurry to the annular groove means 10 and comprise a vertical flow pipe 1 having a vertical axis and an open bottom end 2. At least one dripping pipe 3 is provided, which is parallel to and laterally offset from the flow pipe 1 and has an open bottom end 9, which is spaced above and vertically aligned with the annular groove means 10. The dripping pipe is provided at its top end with a collecting funnel 4, which is spaced below and upwardly inclined toward the bottom end 2 of the flow pipe 1 and is spaced from the axis thereof.

Jetting means for discharging a variable pulsed air jet through said vertical axis of said feed pipe 1 below the latter toward the collecting funnel 4 comprise the jet nozzle 5 and are controllable by suitable means to vary the strength and/or the pulse rate of said jet.

The reservoir 7 is open-topped and disposed below the collecting funnel 4 and vertically aligned with the bottom end of the flow pipe 1 and serves to collect abrasive slurry.

The annular groove means 10 may comprise a plurality of radially spaced apart grooves, which are centered on the axis of rotation X. A plurality of dripping pipes 3 may be provided, each of which is provided with a collecting funnel 4 and has an open bottom end, which is spaced above and vertically aligned with one of said annular grooves 10. The jetting means may comprise a plurality of jet nozzles 5, each of which is disposed on that side of the vertical axis of the flow pipe 1 which is opposite to one of the funnels 4.

We claim:

1. In a finish-machining machine comprising an upper and a lower finishing disk, which are mounted to be rotatable on a vertical axis of rotation, said upper disk having a top surface and a bottom surface, which faces and defines a working gap with said lower disk, and feeding means for feeding an abrasive slurry to said working gap, the improvement residing in that said upper disk is formed in said top surface with annular groove means centered on said axis and is formed with a plurality of bores, which are spaced around said axis and open to said groove means and in said bottom surface of said upper disk, and said feeding means comprise supplying means for supplying said abrasive slurry to said annular groove means and scraping means, which extend into said groove means and are mounted to be rotatable on said axis relative to said upper disk, wherein means are provided for rotating said upper disk on said axis and said feeding means comprise a speed sensor for indicating a rotation of said upper disk at a speed below a predetermined speed and drive means for rotating said scraping means about said axis when said speed sensor indicates a rotation of said upper disk at a speed below said predetermined speed.

2. The improvement set forth in claim 1, wherein said scraping means comprise a plurality of scrapers, which extend into said annular groove means and constitute an array which is centered on said axis.

3. The improvement set forth in claim 1, wherein said machine comprises a top frame, self-aligning bearing means for mounting said upper disk in said top frame for rotation on said axis for a self-aligning movement relative to said top frame, and mounting means for movably mounting said drive means in said top frame so as to retain said drive means against an angular movement relative to said top frame about said axis and to permit said drive means to perform said self-aligning movement in unison with said upper disk.

4. The improvement set forth in claim 1, wherein said machine comprises a top frame, a carrier, which is mounted in said top frame to be rotatable on said axis and is non-rotatably connected to said upper disk, bearing means, by which said scraping means and said drive means for retaining said drive means against an angular movement relative to said top frame about said axis.

5. The improvement set forth in claim 1, wherein said drive means are operable to rotate said scraping means in a sense which is opposite to the sense of rotation of said upper disk.

6. The improvement set forth in claim 1, wherein said supplying means comprise a vertical flow pipe having a vertical axis and an open bottom end, at least one dripping pipe, which is parallel to and laterally offset from said flow pipe and has an open bottom end, which is spaced above and vertically aligned with said annular groove means and a top end and is provided at said top end with a collecting funnel, which is spaced below and upwardly inclined toward said bottom end of said flow pipe and is spaced from the axis thereof, and jetting means for discharging a variable pulsed air jet through said vertical axis of said feed pipe below the latter toward said collecting funnel.

7. The improvement set forth in claim 6, wherein said jetting means comprise a jet nozzle, which is disposed on that side of said vertical axis of said flow pipe which is opposite to said collecting funnel.

8. The improvement set forth in claim 6, wherein said jetting means are operable to vary the strength of said jet.

9. The improvement set forth in claim 6, wherein said jetting means are operable to vary the pulse rate of said jet.

10. The improvement set forth in claim 6, wherein said jetting means are operable to vary the strength and the pulse rate of said jet.

11. The improvement set forth in claim 6, wherein said flow pipe has at said bottom end a beveled end face.

12. The improvement set forth in claim 6, wherein an open-topped reservoir for collecting abrasive slurry is disposed below said collecting funnel and vertically aligned with said bottom end of said flow pipe and means are provided for recycling abrasive slurry from said reservoir to said flow pipe.

13. The improvement set forth in claim 6, wherein said annular groove means comprise a plurality of radially spaced apart annular grooves centered on said axis of rotation, said supplying means comprise a plurality of said dripping pipes, each of which is provided with one of said collecting funnels and has an open bottom end, which is spaced above and vertically aligned with one of said annular grooves, and said jetting means comprise a plurality of jet nozzles, each of which is disposed on that side of said vertical axis of said flow pipe which is opposite to one of said collecting funnels.

* * * * *